United States Patent [19]

Gronlie

[11] 4,074,537

[45] Feb. 21, 1978

[54] DOCK BRACKET

[76] Inventor: John Peter Gronlie, 4248 - 41st Ave. South, Minneapolis, Minn. 55406

[21] Appl. No.: 798,137

[22] Filed: May 18, 1977

[51] Int. Cl.[2] ..... F02B 3/20

[52] U.S. Cl. ..... 61/48; 52/645; 61/67; 248/287; 403/169

[58] Field of Search ..... 61/48, 65, 67; 248/188.4, 188.3, 287, 245; 182/147, 201; 403/169, 217; 52/645, 646, 648, 647

[56] References Cited

U.S. PATENT DOCUMENTS

| | | | |
|---|---|---|---|
| 2,044,703 | 6/1936 | Kline | 61/48 |
| 2,564,123 | 8/1951 | Melges et al. | 61/48 |
| 2,571,337 | 10/1951 | Burnham | 61/48 |
| 2,656,224 | 10/1953 | Gray | 52/646 X |
| 2,879,087 | 3/1959 | Haglund | 403/169 |
| 3,006,669 | 10/1961 | Novales | 403/217 |
| 3,007,727 | 11/1961 | Ryan | 403/169 |
| 3,938,290 | 2/1976 | Wyatt | 403/217 X |

*Primary Examiner*—Dennis L. Taylor
*Attorney, Agent, or Firm*—Orrin M. Haugen

[57] ABSTRACT

A dock means for providing an elevated support and walking ramp over the surface of a body of water adjacent to shore which includes an elongated ramp having laterally disposed support stringers with a walking surface secured to the upper edge thereof. Cradle means are secured to the stringers with each member of each pair of cradles being secured in opposed relationship along the axis of the stringers. Sleeve means are secured to the cradle means, with the axis of the sleeve being disposed generally transverse to the axis of the stringers. Post means are arranged to be positioned laterally adjacent each of the cradle means for supporting the stringers, with the post means having pad means secured to the base. A second sleeve means is arranged to be vertically adjustably attached to the post. A third sleeve is secured to the second sleeve and is arranged to be held in continuation with the sleeve attached to the cradle means, and a cross-member support is arranged to be lockably received within the sleeve attached to the vertically adjustable sleeve. This arrangement provides for both vertical and lateral stability, along with ease of assembly and disassembly.

5 Claims, 5 Drawing Figures

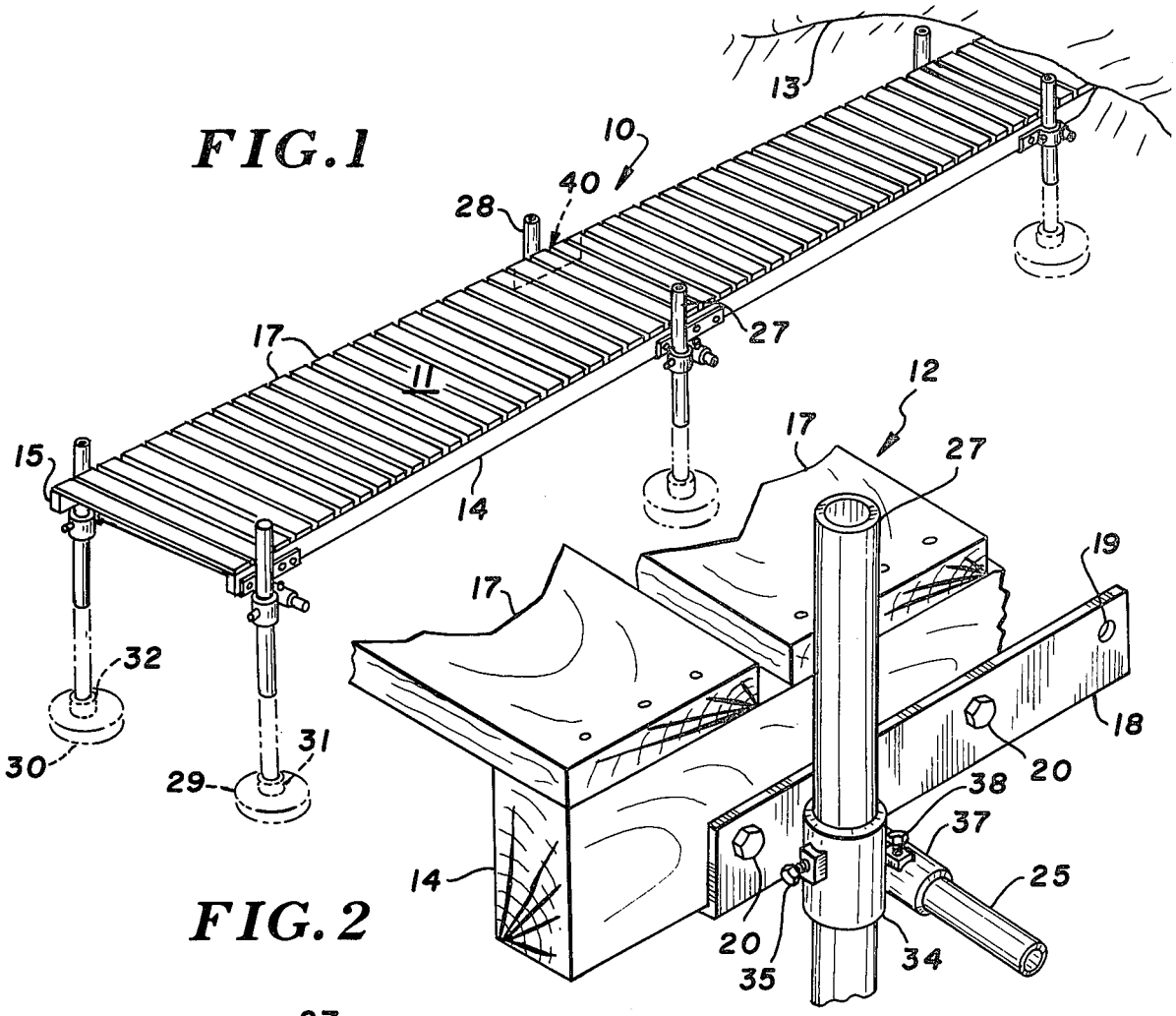
FIG. 1
FIG. 2
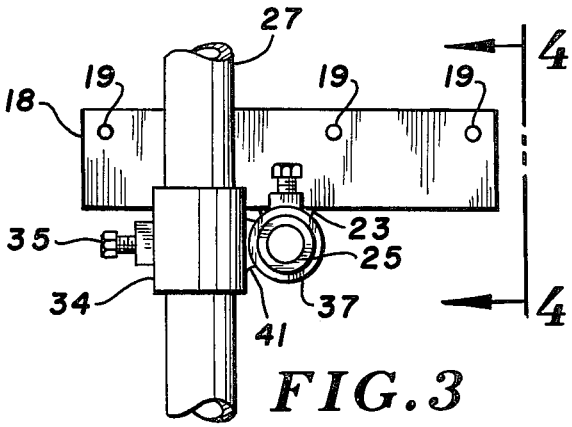
FIG. 3
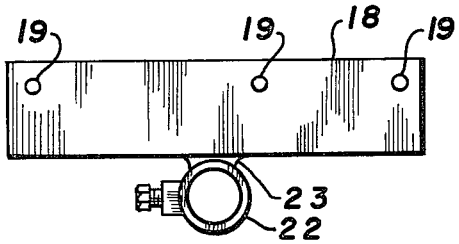
FIG. 5
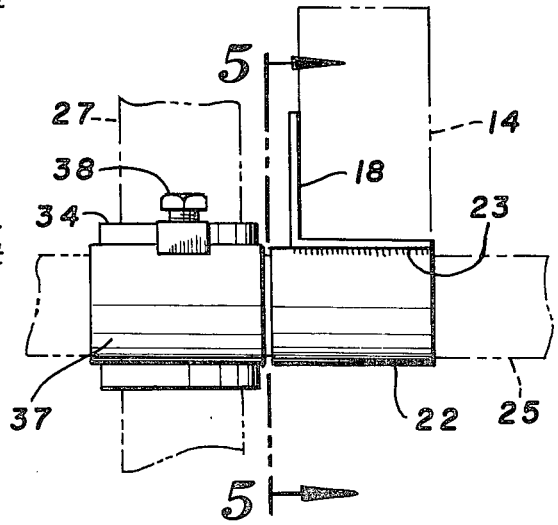
FIG. 4

DOCK BRACKET

BACKGROUND OF THE INVENTION

The present invention relates generally to an improved shoreline dock means, and more particularly to a shoreline dock means which is arranged to be temporarily erected and removed on a seasonal basis. In those areas where lakes become ice covered in the wintertime, it is necessary to remove the docks prior to freeze-up in order that they do not become damaged or destroyed due to shifting of ice flows during the winter and spring.

Various techniques have been provided for simplifying the erection of docks, and assemblies frequently suffer from a lack of either vertical or lateral stability. In order to render these docks comfortable and safe for use, they must be positioned firmly so that they do not wobble or shift when people are walking upon them. Lateral stability and support is particularly important, since these docks are more frequently used for persons to enter and leave a small watercraft such as a boat, canoe, or the like.

In the structure of the present invention, a dock means is provided which utilizes a elongated ramp having laterally disposed support stringers to support a walking surface thereon. A plurality of pairs of stringer cradles are provided, with each member of each pair being secured in opposed relationship along the support stringer. A first sleeve means is secured to the cradle means with the sleeve means having a bore formed therein and extending generally transversely of the axis of the stringer. A support post is arranged to be positioned laterally outwardly of each of the cradle means, with a second sleeve means being arranged to be vertically adjustably attached to the post. A third sleeve is coupled to the second sleeve and is arranged to receive a transverse support beam therethrough. The transverse support means is arranged to extend through opposed pairs of the first sleeve means attached to the stringer cradle as well as the third sleeve means which is secured in vertically adjustable position on the support post. In this fashion, therefore, it is possible to erect the dock assembly in firm position both vertically and laterally so as to provide a firm and sound walking surface for the users.

In order to provide for an appropriate support for each of the post means, a pad is secured to the base, and one type of pad means which has been found desirable is in the form of an inverted cup, with the depth dimension of the inverted cup providing for lateral stability in soft sandy areas. Such a pad means is preferred over a conventional floor plate or the like which normally has little if any depth dimension.

SUMMARY OF THE INVENTION

Threfore, it is a primary object of the present invention to provide an improved dock means which is easy to assemble and erect, and which provides stable support both vertically and laterally.

It is a further object of the present invention to provide an improved dock assembly which may be readily and easily assembled, and which may be fabricated from readily available component parts.

It is yet a further object of the present invention to provide an improved dock means which may be readily assembled, and which can be adjustably re-positioned to accommodate for changes in water level during the various seasons of the year.

Other and further objects of the present invention will become apparent to those skilled in the art upon a study of the following specification, appended claims, and accompanying drawing.

BRIEF DESCRIPTION OF THE DRAWING

FIG. 1 is a perspective view of a dock assembly prepared in accordance with the present invention, and illustrating the arrangement as it is normally positioned in a shoreline installation;

FIG. 2 is a detail perspective view of a support assembly which is utilized in connection with the arrangement of the present invention, with FIG. 2 showing fragmentary portions only, and being on a slightly enlarged scale;

FIG. 3 is a side elevational view of a segment only of a support post, to which is secured a sleeve means, and further illustrating, in side elevational view, a stringer cradle;

FIG. 4 is a side elevational view taken along the line and in the direction of the arrows 4—4 of FIG. 3, and showing the support stringer, the cross-member support, and the post means in phantom; and FIG. 5 is a vertical sectional view taken along the line and in the direction of the arrows 5—5 of FIG. 4.

DESCRIPTION OF THE PREFERRED EMBODIMENT

In accordance with the preferred embodiment of the present invention, and with particular attention being directed to FIG. 1 of the drawing, the dock assembly generally designated 10 includes a support and walking ramp generally designated 11 which provides an elevated support over the surface of the body of water shown generally at 12. The dock means 10 is positioned adjacent a shoreline 13, as is conventional.

Structurally, the supporting locking ramp 11 consists of an elongated ramp having laterally disposed support stringers 14 and 15, with a walking surface secured to the upper edges thereof. In the embodiment illustrated in the drawing, the walking surface is in the form of a plurality of spaced-apart transverse boards 17—17, as is conventional in dock construction. In order to provide for proper support of the elongated ramp, a plurality of support posts and other support members are provided, as will be more fully described hereinafter.

With particular attention now being directed to FIG. 2 of the drawing, one of a plurality of pairs of stringer cradle means is shown as at 18, with the stringer cradle means being bolted to the laterally disposed stringer 14, where indicated. Cradle means 18 is in the form of an angle iron, such angle iron materials being, of course, readily available in stock form. A plurality of bores are formed in each of the cradle means, such as at 19, in order to receive the mounting bolts 20—20, and thereby be secured to the support stringers as indicated. Members 17—17 are coupled or attached to the stringers 14 by nailing, as indicated.

With attention now being directed to FIG. 4 of the drawing, it will be seen that a first sleeve means 22 is secured to the base of cradle 18, by means of a weld fillet, braze fillet, or the like as at 23. Sleeve means 22 is in the form of a casing having a bore formed therein, with the axis of the bore being, as indicated, substantially transverse to the axis of the stringers. The bore of sleeve 22 is arranged to receive a cross-member such as the cross-member 25 therein, with cross-member 25 being illustrated in phantom in FIG. 4, and more fully explained hereinafter.

As will be apparent from a review of the structure of FIG. 1, each of the stringer cradle means are provided in pairs, with each member of each pair of the cradles being secured in opposed relationship, one to another, along the stringers 14 and 15. The stringer cradle means are provided in this fashion in order to permit the cross-member support to extend across the entire dock assembly, and thereby provides for rigid and durable support.

Post means are positioned laterally adjacent each of the cradle means, as at, for example, 27 and 28. Each of the post means in the illustration of FIG. 1 is substantially identical, one to another, with the exception of those posts being arranged for outward disposition being longer than those for inward disposition. This again, is conventional in the dock art. Each of the posts, such as posts 27 and 28, is provided with a pad means at the base thereof, such as at 29 and 30. Each of the pad means is in the form of an inverted cup or bowl, and has a bore formed centrally thereof as at 31 and 32. The bore receives the post means therewithin, and provides for vertical support of the post, and also resists any lateral shifting in normal water body bottom materials. One particular type of base pad which has been found particularly useful is a used or discarded brake drum from an automobile, with these devices having a bore formed centrally thereof, as is required, and with the devices being in the form of an inverted cup or bowl. Such brake drum casings or housings are, of course, readily available in virtually any automotive junkyard.

A second sleeve means is arranged to be vertically adjustably attached to the post, as shown in FIG. 3 at 34. The sleeve 34 may be in the form of a length of pipe or other casing, as is the case for all of the sleeve means employed in the structure of the present invention. A locking means in the form of a set screw is shown at 35, with the set screw being arranged to pass through the wall of sleeve 34 and engage and lock the arrangement to the surface of the post upon which it is mounted, such as, for example, post 27 in this example. The arrangement is such that the second sleeve means permits the entire assembly to be lockably retained on the surface of the post 27.

With continued attention being directed to FIGS. 3 and 4, it will be observed that a third sleeve means is provided as at 37, with this sleeve means being normally disposed in axial continuation with sleeve means 22. A locking means is provided on sleeve 37, as at 38, with locking means 38 being arranged to engage and secure sleeve 37 to cross-member support 25. In actual mounted disposition, the ends of sleeves 22 and 37 will be in actual contact, one with the other, to enhance the lateral stability of the overall structure.

As has been indicated, the cross-member support means 25 is arranged to extend across the entire base of the dock arrangement, and is further arranged to be slideably received within the opposed sleeve means, such as opposed pairs of sleeve means 22 and 37, and their opposite members. Cross-member support means 25 extends transversely of the lateral stringers 14 and 15 and accordingly through the opposed pairs of sleeves. In the example illustrated in FIG. 4, a left-hand assembly is illustrated, and it will be appreciated that a corresponding right-hand member will be mounted on the opposed side, as shown in phantom as at 40. Similar pairs will, of course, be provided across the entire arrangement.

As has been indicated, the support bolts are arranged laterally outwardly of the stringers, although it will be appreciated that these members may be disposed laterally inwardly with some minor modification. Also, the cross-member is preferably a cylindrical hollow pipe to permit selection of components from readily available materials, and also to permit ease of handling in order to controllably raise and lower the structure during erection and dismantling.

Preferably, the sleeve members are mounted or secured to each other by means of welding or brazing, with weld fillets being shown at 41 and also as at 23. It will be appreciated, of course, that other techniques may be employed for coupling the components of the various sub-assemblies together.

I claim:

1. Shoreline dock means for providing an elevated support and walking ramp over the surface of a body of water adjacent the shore and comprising in combination:

a. an elongated ramp having laterally disposed support stringers with a walking surface secured to the upper edge thereof;

b. a plurality of pairs of stringer cradle means secured to said stringers with each member of each pair of said cradles being secured in opposed relationship, one to another, and said stringers and with each of said cradle means having a first sleeve means secured to one of said cradle means with said sleeve means comprising a casing having a bore formed therein and extending generally transversely to the axis of said stringer;

c. post means arranged to be positioned laterally adjacent each of said cradle means for supporting said ramp and having pad means secured to the base thereof and with a second sleeve means arranged to be vertically adjustably attached thereto, with said second sleeve means comprising a casing having a bore formed therein to be slideably retained on said post means and locking means for lockably retaining said second sleeve means on said post;

d. third sleeve means secured to said second sleeve means and comprising a casing having a bore formed therein and with said bore extending generally at right angles to the bore in said second sleeve means;

e. cross-member support means arranged to be slideably received within said first and third sleeve means and extending transversely of said lateral stringers and through opposed pairs of said first sleeve means and arranged to be lockably received within opposed pairs of said first sleeve means; and f. locking means coupled to said first sleeve means for adjustably securing said cross-member support means thereto.

2. The shoreline dock means as defined in claim 1 being particularly characterized in that said cross-member support means extends laterally outwardly of said third sleeve means.

3. The shoreline dock means as defined in claim 2 being particularly characterized in that said cross-member is a cylindrical hollow pipe.

4. The shoreline dock means as defined in claim 1 being particularly characterized in that each of said locking means is a set screw.

5. The shoreline dock means as defined in claim 1 being particularly characterized in that said stringer cradle means is an angle iron member with legs of substantially equal length.

* * * * *